United States Patent [19]

Kessler et al.

[11] 4,106,244

[45] Aug. 15, 1978

[54] COOLING TOWER

[75] Inventors: Erich Kessler, Krefeld; Georg Hassemer, Bickenbach; Paul Weber, Goddelau, all of Fed. Rep. of Germany

[73] Assignee: Fried. KRUPP Gesellschaft mit beschränkter Haftung, Essen, Fed. Rep. of Germany

[21] Appl. No.: 281,106

[22] Filed: Aug. 16, 1972

[30] Foreign Application Priority Data

Aug. 25, 1971 [DE] Fed. Rep. of Germany ..... 2142491

[51] Int. Cl.[2] ..... E04H 5/12

[52] U.S. Cl. ..... 52/63; 52/83; 261/DIG. 11

[58] Field of Search ..... 52/63, 83, 720, 80; 135/1 C, 1 D, 3 B, 3 C, 8; 261/DIG. 11

[56] References Cited

U.S. PATENT DOCUMENTS

| | | | |
|---|---|---|---|
| 459,764 | 9/1891 | Orr | 52/83 |
| 2,527,729 | 10/1950 | Hoff | 135/1 D |
| 2,804,951 | 9/1957 | Kolt | 52/83 |
| 3,139,957 | 7/1964 | Fuller | 52/83 |
| 3,196,061 | 7/1965 | Paulson | 52/720 |
| 3,422,883 | 1/1969 | Daltry | 52/83 |
| 3,619,958 | 11/1971 | Vesi | 52/83 |
| 3,637,193 | 1/1972 | Kugler | 52/83 |

FOREIGN PATENT DOCUMENTS

| | | | |
|---|---|---|---|
| 1,414,214 | 9/1965 | France | 135/3 C |
| 1,183,193 | 3/1970 | United Kingdom | 52/80 |
| 1,229,887 | 4/1971 | United Kingdom | 52/83 |

*Primary Examiner*—Ernest R. Purser
*Assistant Examiner*—H. E. Raduazo
*Attorney, Agent, or Firm*—Walter Becker

[57] ABSTRACT

A cooling tower with a non-self-supporting envelope which is supported by a net of cables and by pulling elements extending from a portion of a supporting post which portion protrudes upwardly beyond the outlet opening of the cooling tower mantle, in which annular means surround the outlet opening of the mantle and are connected to the supporting post by elements extending in a spoke-like manner from the supporting post and at least partially subjected to pull only.

4 Claims, 6 Drawing Figures

COOLING TOWER

The present invention relates to a cooling tower the mantle of which consists of a non-self-supporting envelope or cover with a net supporting the cover and consisting of cables and also with suspension members carrying the net, the suspension members extending from a point of the post which protrudes beyond the outlet opening of the mantle.

This design avoids the heavy struts which with older constructions were employed for supporting the ring relative to the post which ring surrounds the outlet opening of the mantle. By employing pulling elements for suspending the ring on the upwardly extended post, weight and costs are saved to a considerble extent.

It is an object of the present invention so to design a cooling tower of the above described general character that a further saving in weight and construction costs will be realized.

This object and other objects and advantages of the invention will appear more clearly from the following specification in connection with the accompanying drawings, in which:

FIG. 1 diagrammatically illustrates a cooling tower according to the invention in which the outlet opening of the mantle of the cooling tower is surrounded by a rigid spacer ring hanging from the tip of the post.

Figure 4:
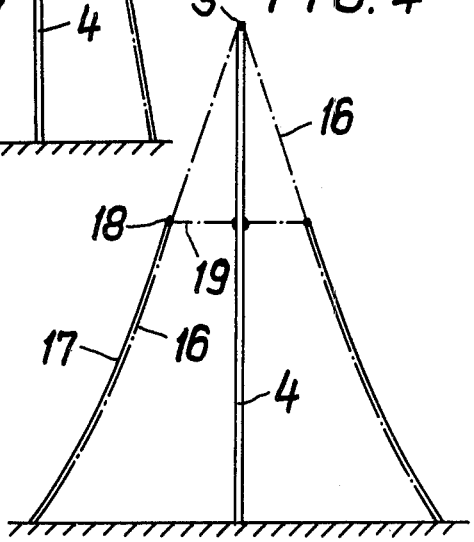

FIG. 4 diagrammatically illustrates a cooling tower according to the invention in the form of a tent according to which the cables of the net are so guided that the upper portion of the mantle supported by the cables forms a truncated cone.

Figure 5:
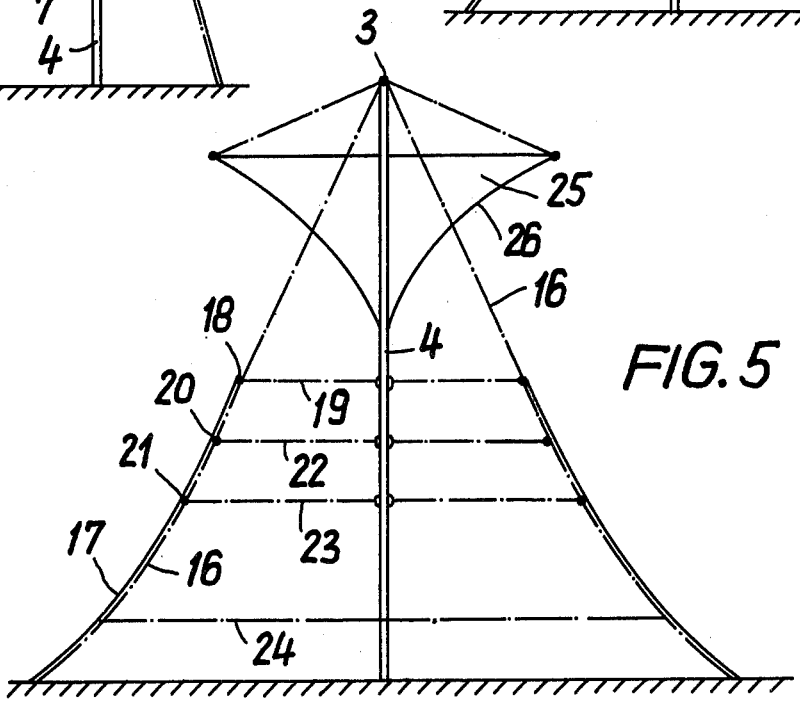

FIG. 5 shows still another embodiment of the invention according to which no spacer ring proper is employed.

Figure 1:
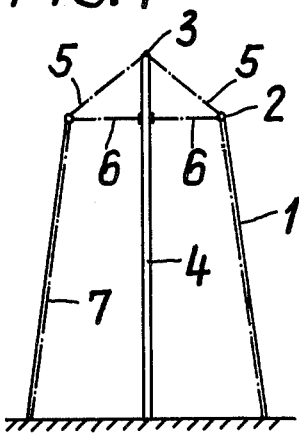
Figure 6:
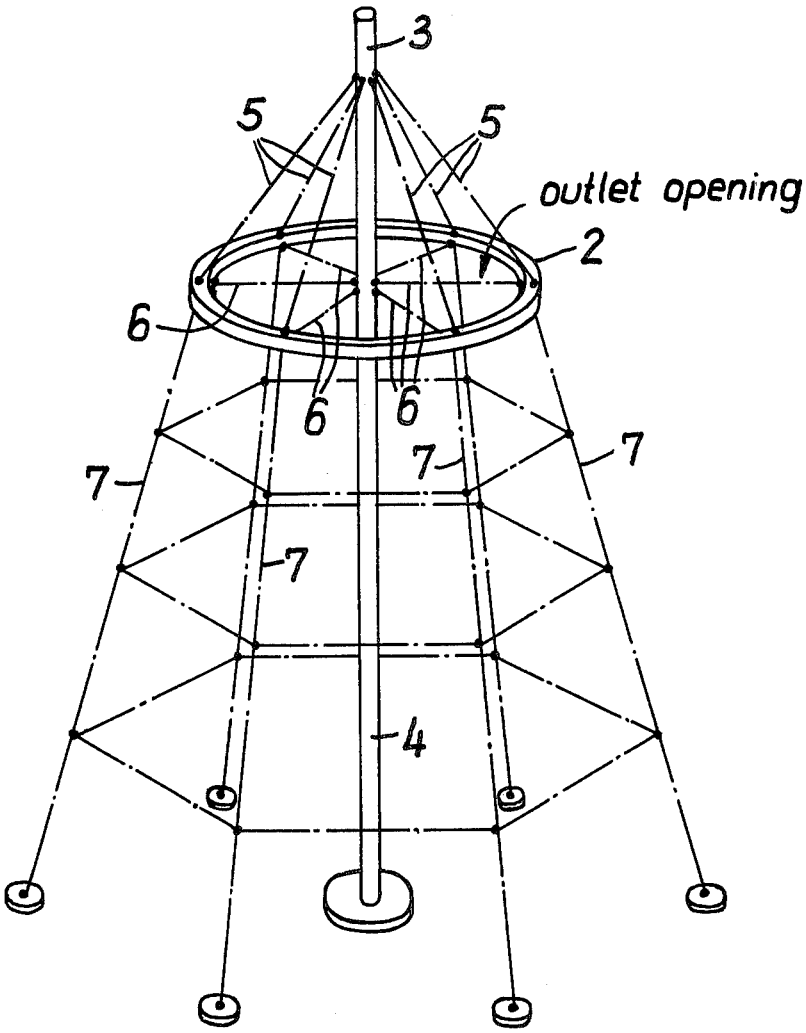

FIG. 6 shows the cooling tower according to FIG. 1 in a perspective view; the mantle being omitted.

The cooling tower according to the present invention is characterized primarily in that the ring surrounding the outlet opening of the mantle is connected to the post, at least partially, by spokes which are subjected to pull only.

Heretofore the ring surrounding the outlet opening of the mantle, which ring represents the spacer ring, was connected to the post by pressure resistant spokes. Such spokes, particularly with cooling towers of large dimensions, have a relatively great weight for preventing buckling, which drawback is avoided when employing expediently preloaded cables or the like as spokes.

With a cooling tower according to the invention it is possible below the ring surrounding the outlet opening of the mantle (this ring forming the spacer ring) to connect to the net a ring which is subjected only to pull stresses and the radius of which is smaller than that of the spacer ring. If desired, also two or more rings subjected to pull stresses only may be connected to the net below the spacer ring with such dimensions and in such an arrangement that a nozzle-shaped axial sectional profile of the mantle is obtained. This affords the possibility of so designing the mantle surface at minimum costs that particularly favorable flow conditons for the rising air are obtained. Also the rings arranged below the spacer ring may be connected to the post by spokes subjected to pull stresses only.

When at least the upper portion of the mantle has a conical or truncated pyramidal design, a cooling tower according to the invention may be so designed that the pulling members which carry the net and which originate at the upwardly extended post will at the outlet opening of the mantle form buckle-free extensions of generatrices of the truncated cone or pyramid.

In this instance the ring surrounding the outlet opening of the mantle need not be designed as spacer ring, in other words, it is not necessary to make the ring pressure resistant, but it may be formed of cables in which instance it may have the shape of a polygon. Also this cable ring may be connected to the post by spokes subjected to pull stresses only.

Preferably in connection with the last mentioned design it may be expedient to cover the outlet opening of the mantle, particularly when it has a large diameter, with a cap which latter is mounted on that portion of the post which protrudes beyond the outlet opening of the mantle and which has deflecting surfaces for the rising air.

Referring now to the drawing in detail and FIG. 1 thereof in particular, the cooling tower shown therein comprises a rigid spacer ring 2 which surrounds the outlet opening of the mantle 1 of the cooling tower. This spacer ring 2 is suspended by means of cables 5 on the tip 3 of the post 4 which is upwardly extended beyond the outlet opening. The cables 5 are connected to the spacer ring 2 at points evenly distributed over the circumference of the ring 2.

The spacer ring 2 is connected to the post 4 by spokes 6 formed by preloaded cables which thus act, so to speak, like the spokes in a bicycle wheel. The cables 7 forming the net extend from the spacer ring 2 toward the foundations in such a way that the mantle 1 supported by the net forms a truncated cone.

Figure 2:
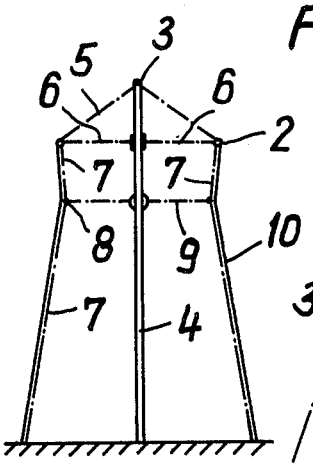
FIG. 2 illustrates another embodiment of a cooling tower according to the invention which differs from that of FIG. 1 in that below the spacer ring there is provided another ring which is connected to the net.

The embodiment of FIG. 2 differs from that of FIG. 1 primarily in that below the spacer ring 2 there is provided a further ring 8 which is connected to the net 7. This ring 8 has a smaller diameter than that of the spacer ring 2 and need consist only of non-rigid material and, more specifically, may consist of cables inasmuch as ring 8 is subjected to pull stresses only. Ring 8 is connected to the post 4 by cables 9 arranged in the manner of spokes.

Figure 3:
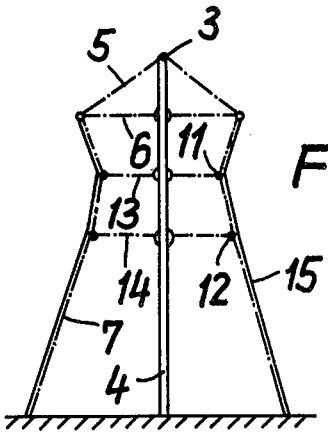
FIG. 3 shows still another embodiment of the cooling tower of the invention according to which two rings are arranged in spaced relationship to each other and to the spacer ring.

The mantle 10 of the cooling tower carried by the net 7 is due to the ring 8 provided with a constriction so that its shape will be similar to that of a nozzle. This design is even more pronounced in FIG. 3 according to which below the spacer ring 2 there are provided two rings 11 and 12. Of these rings 11 and 12 the upper ring 11 has a considerably smaller diameter than the spacer ring 2, whereas the lower ring 12 has a somewhat larger diameter than ring 11. Also the rings 11 and 12 may consist of cables and may have polygonal shape, the rings 11 and 12 being connected to the cables 7 of the net. Rings 11 and 12 are likewise connected to post 4 by cables 13 and 14 arranged in the manner of spokes. The mantle 15 thus has a axial cross-sectional profile which stepwise resembles that of a nozzle profile.

According to the embodiment shown in FIG. 4, the cables 16 of the net are so arranged that the upper part of the mantle 17 carried by cables 16 forms a truncated cone while the mantle flares in downward direction. The outlet opening at the upper rim of the mantle 17 is surrounded by a ring 18 which is formed from cable sections arranged in the shape of a polygon, these cable sections being connected to the cables 16. The cables 16 continue beyond the ring 18 toward the tip 3 of the post 4 without changing their directions and thus having their upper ends form the suspension cables for the net. Since the cables 16 extend rectilinearly beyond the ring 18 and are under a preload, ring 18 does not have to absorb any major pressure stresses. It is for this reason that in this embodiment no spacer ring proper is necessary. Ring 18 is connected to post 4 by spokes 19 formed by cables. Such a design is suited for particularly large surface cooling towers which also contain power plant equipment. FIG. 5 shows a particularly wide cooling tower of this type.

A cooling tower of the type shown in FIG. 5 in addition to comprising the ring 18 surrounding the outlet opening of the mantle 17 also comprises two rings 20 and 21 of the same type arranged below the ring 18. The spokes 19, 22 and 23 consist of cables. Within the lower or base part of the cooling tower there are provided inserts, such as power plant equipment, as indicated by the dot-dash line 24.

The outlet opening within ring 18 has a relatively large diameter. In order to protect the equipment in the cooling tower against any precipitation, above the outlet opening on post 4 there is provided a cap 25 the bottom side of which has outwardly pointing curved deflecting surfaces 26 for deflecting the air rising from the cooling tower.

It is, of course, to be understood that the present invention is, by no means, limited to the specific embodiments shown in the drawing but also comprises any modifications within the scope of the appended claims.

What we claim is:

1. A cooling tower having an exit opening and comprising in combination:

(a) a foundation and a post mounted thereon, (b) a rigid upper spacer ring below the top of said post surrounding the exit opening, (c) cable means under tension on said post projecting downwardly and over the exit opening and having said rigid upper spacer ring suspended thereby, (d) one smaller spacer ring arranged below said upper spacer ring, (e) cables guided from fastening locations on said upper spacer ring to fastening locations on said lower spacer ring and to fastening locations on said foundation spaced outwardly from said post a greater distance than said lower spacer ring, (f) whereby the fastening locations on said lower spacer ring have a smaller distance from said post than the fastening locations on said upper spacer ring and than the fastening locations on said foundation, (g) radial cable-type connection means provided between said spacer rings and said post that are capable of being loaded only under tension exclusively and then are preloaded under tension only for resistance against wind forces, (h) a non-self-supporting mantle laced in at said lower spacer ring particularly to withstand wind forces as supported by said cables and extending downwardly from said upper spacer ring to leave an opening through said upper and lower rings.

2. A cooling tower in combination according to claim 1 in which said lower spacer ring is capable of being loaded only under tension.

3. A cooling tower having an exit opening and comprising in combination:

(j) a foundation and a post mounted thereon, (k) a rigid upper spacer ring below the top of said post surrounding the exit opening, (l) cable means under tension on said post projecting downwardly and over the exit opening and having said rigid upper spacer ring suspended thereby, (m) at least two lower spacer rings arranged below aaid upper spacer ring and one below the other, said other ring adjacent said upper ring being smaller than the upper spacer ring, (n) cables guided from fastening locations on said upper spacer ring to fastening locations on said lower spacer rings and to fastening locations on said foundation spaced outwardly from said post a greater distance than said other of said lower rings and said upper ring, (o) whereby the fastening locations on that lower spacer ring which is nearest to said upper spacer ring have a smaller distance from said post than the fastening locations on said upper spacer ring, and (p) whereby the fastening locations on the lowermost of said lower spacer rings have a smaller distance from said post than the fastening locations on said foundation, (q) radial cable-type connection means provided between said spacer rings and said post are capable of being loaded only under tension and are preloaded exclusively under tension rather than also being subjected to pressure, kinking or bending load for resistance against wind forces, (r) a non-self-supporting mantle laced in at said lower spacer rings particularly to withstand wind forces as supported by said cables and extending downwardly from said upper spacer ring to leave an opening through said rings.

4. A cooling tower in combination according to claim 3 in which said lower spacer rings are capable of being loaded only under tension.

* * * * *